US009666950B1

(12) United States Patent
Johnson

(10) Patent No.: US 9,666,950 B1
(45) **Date of Patent: *May 30, 2017**

(54) BICONICAL ANTENNA ASSEMBLY WITH BALUN FEED

(71) Applicant: Greg Johnson, Aptos, CA (US)

(72) Inventor: Greg Johnson, Aptos, CA (US)

( * ) Notice: Subject to any disclaimer, the term of this patent is extended or adjusted under 35 U.S.C. 154(b) by 411 days.

This patent is subject to a terminal disclaimer.

(21) Appl. No.: 14/445,045

(22) Filed: Jul. 28, 2014

Related U.S. Application Data

(60) Provisional application No. 61/858,745, filed on Jul. 26, 2013, provisional application No. 61/968,879, filed on Mar. 21, 2014.

(51) Int. Cl.
*H01Q 13/04* (2006.01)
*H01Q 1/42* (2006.01)
*H01Q 1/50* (2006.01)

(52) U.S. Cl.
CPC ..... *H01Q 13/04* (2013.01); *H01Q 1/42* (2013.01); *H01Q 1/50* (2013.01)

(58) Field of Classification Search
CPC ..... H01Q 13/04
USPC ..... 343/773
See application file for complete search history.

(56) References Cited

U.S. PATENT DOCUMENTS 3,942,180 A * 3/1976 Rannou ..... H01Q 19/06 343/725
8,654,025 B1 * 2/2014 Brock ..... H01Q 13/04 343/752

* cited by examiner

*Primary Examiner* — Robert Karacsony
(74) *Attorney, Agent, or Firm* — Billion & Armitage; John F. Klos

(57) ABSTRACT

An antenna assembly having a pair of generally cone-shaped conductive elements directed in divergent directions, with each pair of conductive elements including a conical sheet conductor and a cylindrical sheet conductor, and radiating wire conductors extending away from each cylindrical sheet conductor. A balun feed system is defined between the pair of conical sheet conductors. A radome assembly protects at least the radiating wire conductors from damage from external forces.

24 Claims, 11 Drawing Sheets

FIG. 10
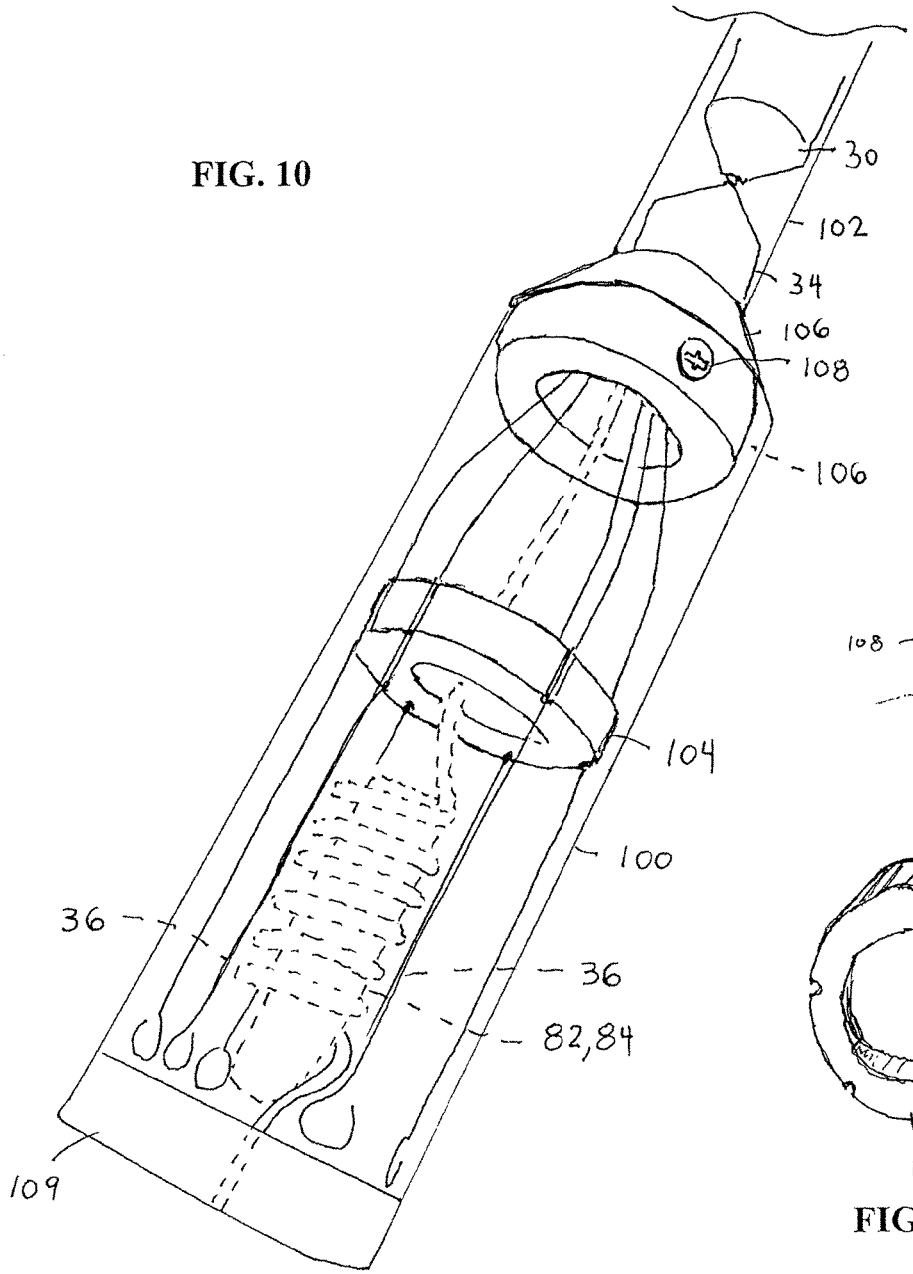
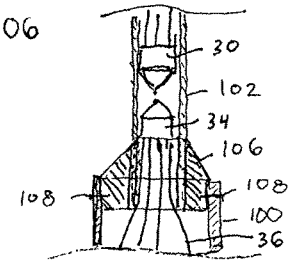
FIG. 12
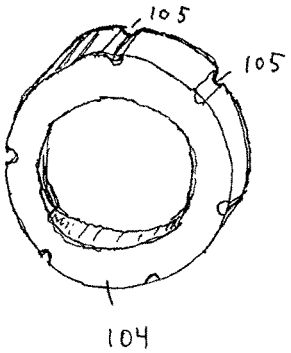
FIG. 11

BICONICAL ANTENNA ASSEMBLY WITH BALUN FEED

RELATED APPLICATIONS

This application claims the benefit of U.S. Provisional Application Nos. 61/858,745 filed Jul. 26, 2013, and 61/968,879, filed Mar. 21, 2014, which applications are incorporated by reference.

TECHNICAL FIELD

The invention relates generally to antennas for operation over multiple frequency bands and more particularly to electronic systems intended to detect or suppress (e.g., prevent, disrupt, jam, interfere with or otherwise disable) radio frequency transmissions between transmitters and receivers occurring within particular frequency bands.

BACKGROUND OF THE INVENTION

Radio frequency ("RF") transmission systems and the various wireless devices that operate within such systems are commercially widely available, and nearly ubiquitous, throughout the world with systems coming on-line daily even in the remotest areas of the world. While commercial RF transmission systems are generally thought to improve the overall well-being of mankind and to advance our society, they have found an unintended use in supporting military or terrorist activity of non-friendly countries, organizations, factions, combatants or other groups.

One way by which these non-friendly groups use commercial RF transmission systems is for communication, command, and control. While many commercial RF transmission systems are not secure, their cost and widespread availability, make them an attractive alternative.

Non-friendly groups also use commercial RF transmission systems as detonators for improvised explosive devices ("IEDs"). Typically, combatants fashion an IED using an explosive (e.g., C4), a container (e.g., an unexploded shell) and an RF detonator. The detonator may be wired to a short range wireless remote control device such as an electronic car key, garage door opener, remote control, cordless telephone, or other short range RF transmission device; or to a long range wireless remote control device such as a cell phone, PDA, pager, a WiFi receiver or other long range RF transmission device to enable remote detonation.

The short range wireless devices, by definition, have a "short" or limited range (e.g., approximately 50 meters, more or less) and typically require line-of-sight operation between the device and the IED. Accordingly, these short range wireless devices pose a significant risk to a combatant (e.g. a terrorist, a foe, a member of a non-friendly group or organization, a neutral party, or other combatant) either in the form of risk of detection or risk of injury from the IED itself. However, exceptions arise more frequently as combatants employ more unique methods of remote detonation via RF transmission, for example, cordless phones.

Existing antennae such as conventional dipoles and monopoles suffer from a number of limitations, including narrow frequency coverage, heavy weight, and high visual profile. Dipoles or monopoles with larger cross-sectional area, referred to as "fat" dipoles, provide increased bandwidth, however, are limited to a 3.5:1 frequency bandwidth before the E plane radiation pattern splits into two lobes with a null perpendicular to the antenna major axis. The discone antenna is capable of operation over frequency bandwidths of 10-15:1, however, the beam peak varies considerably from the horizon with frequency, thus affecting useful range. Biconical dipoles that are symmetrical are well known, but provide limited capability, e.g., provide bandwidths comparable to "fat" dipoles.

Existing antennae, such as disclosed in Applicant's U.S. Pat. No. 8,059,050, incorporated by reference herein, include relatively exposed radiating elements constructed of flexible wire or the like. The flexible radiating elements are exposed and can deflect in response to contact with obstacles and then return to position. In some environments and situations the flexible radiating elements may be excessively deformed and fail to return to position. This excessive deformation of the radiating elements may lead to degradation of the antenna's electrical performance. A need therefore exists for an antenna assembly offering protection against damage to the radiating elements.

In light of these and other limitations, dangers and risks associated with RF transmission systems, what is needed is a system and method for detecting or suppressing (e.g., preventing, disrupting, jamming, interfering with or otherwise disabling) RF transmissions between target transmitters and/or target receivers operating in a particular region, thereby disabling the communication, the remote detonation or otherwise suppressing the RF transmissions.

SUMMARY OF THE INVENTION

To achieve the foregoing objects, and in accordance with the purpose of the invention as embodied and broadly described herein, a multiple element antenna assembly for a radio frequency communication device is provided.

Embodiments of the invention include an antenna assembly defining a pair of divergent conical radiating structures each including a sheet conductor and a plurality of radiating wire conductors attached to the sheet conductor and extending in a predetermined form and direction. The sheet conductors each include conical and cylindrical sections.

A balun is used to prevent radiation of a coax feedline used to connect the antenna to a transmitter/receiver. A frequency range can be optimized by use of a coiled-coax balun including a ferrite rod placed within the coiled-coax solenoid.

A compact, ruggedized, extremely-wide bandwidth antenna is disclosed. The antenna is suitable for operation over a frequency range of at least 80 to 1100 MHZ.

Embodiments of the invention include a transceiver that suppresses one or more signals transmitted from a target transmitter in an RF transmission system to a target receiver in a wireless device operating in the RF transmission system to detect, prevent, disrupt, jam, interfere with or otherwise disable an RF transmission between the target transmitter and the target receiver in the wireless device (i.e., target wireless device).

A protected antenna assembly including one or more dielectric enclosures or radomes is also provided. The antenna assembly may include a polycarbonate tube consisting of one or more sections.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which:

FIG. 10 is a perspective illustration of a radome-protected embodiment of an antenna assembly of the present invention.

FIG. 11 is a perspective view of a dielectric spacer of FIG. 10.

FIG. 12 is a partial cross-sectional view of the antenna assembly of FIG. 10.

DETAILED DESCRIPTION OF THE INVENTION

Figure 1:
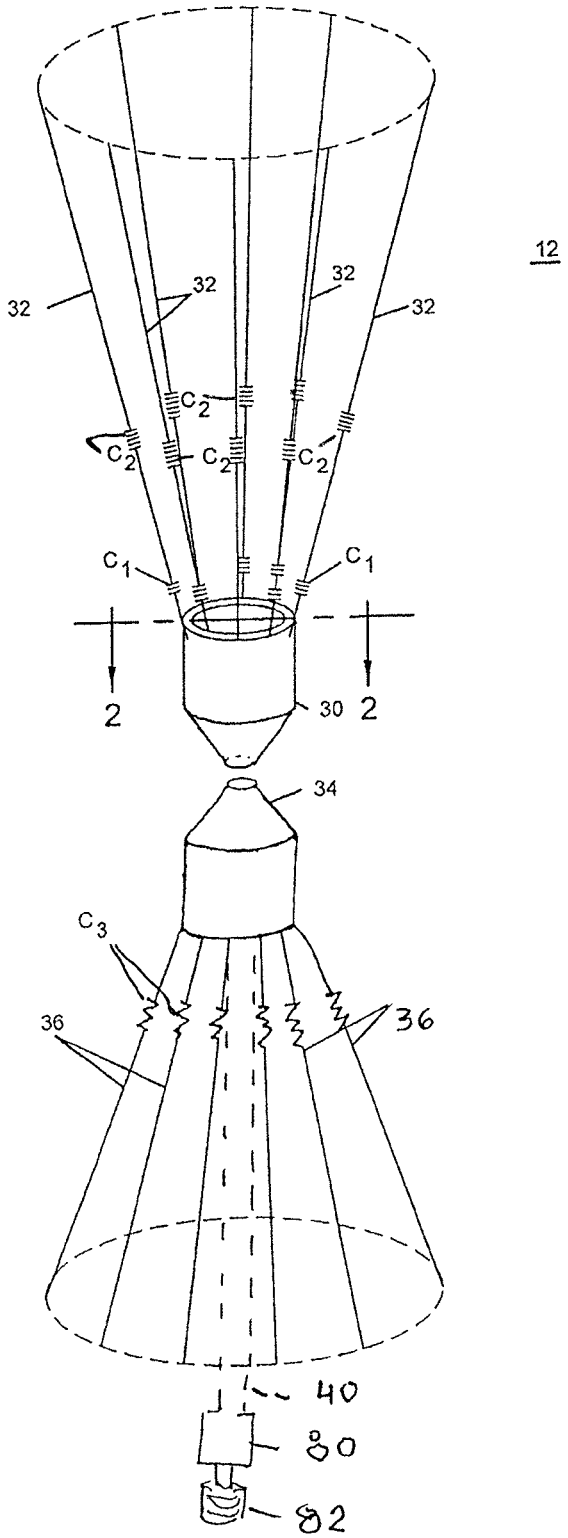
FIG. 1 is a perspective view of an antenna assembly of the present invention.

Referring to FIG. 1, antenna 12 includes an upper portion having a first sheet conductor 30 with a plurality of conductively attached radiating wire conductors 32 aligned and held into a conical shape. The lower portion of antenna 12 includes a second sheet conductor 34 with a number of flexible radiating wire conductors 36 conductively attached and formed into a partial conical shape. Radiating wire conductors 36 of the lower portion of antenna 12 are spaced over approximately 180 degrees. Sheet conductors 30, 34 are thin sheet metal formed into illustrated shapes. Additional details of radiating wire conductors 32, 36 are disclosed in Applicant's U.S. Pat. No. 8,059,050, incorporated herein by reference.

Figure 2:
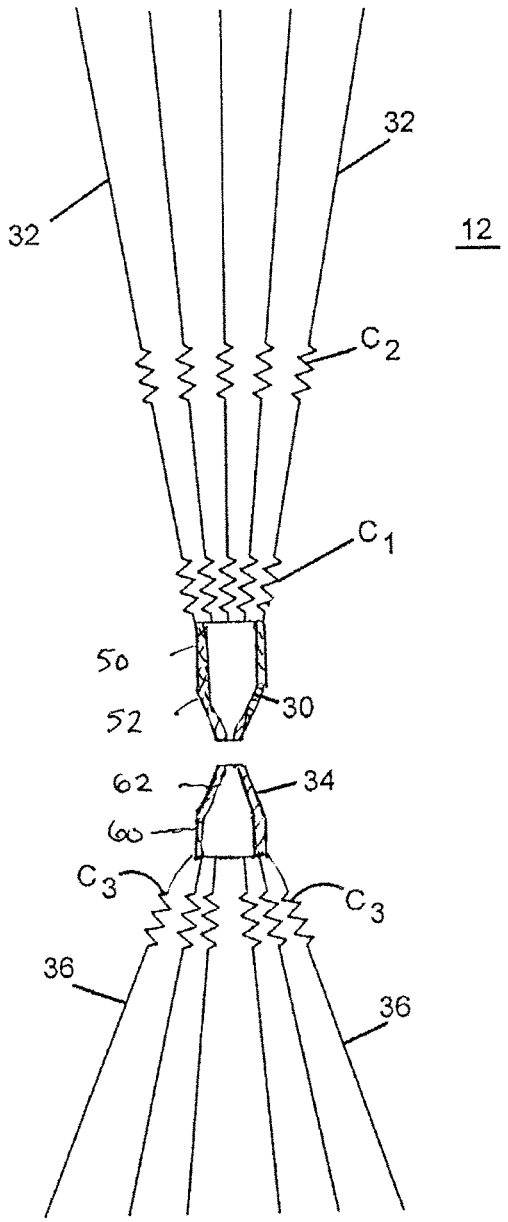
FIG. 2 is a cross-sectional view of FIG. 1 taken along lines 2-2.

Referring to FIG. 2, first sheet conductor 30 includes a generally cylindrical sheet element 50 positioned atop a generally cone-shaped sheet element 52. Sheet conductor 30 may be formed of thin metal elements which are soldered or welded together. Similarly, second sheet conductor 34 includes a generally cylindrical sheet element 60 positioned beneath a generally conical sheet element 62. In a preferred embodiment of the invention, the cylindrical sheet element 50 is approximately 1 inch in diameter and 1 inch in length, and the cone-shaped sheet element 52 is approximately ¾ inch in length.

Together the first and second sheet conductors 30, 34 provide broadband operation for the antenna over a large frequency range in the upper part of the antenna's frequency range. In comparison, the radiating wire conductors 32, 36 provide for operation over the lower frequency range of the antenna.

Antenna 12 incorporates multiple radio frequency chokes (C1, C2, C3) in the radiating wire conductors 32, 36. The RF chokes may be simple conductive coils. Chokes C1, C2, C3 facilitate operation over a frequency range of approximately 34:1 by acting as band stops for a higher radio frequency current frequency band, while permitting rf current at a lower frequency band to pass. The number of turns and turn spacing of chokes C1, C2, C3 are selected for optimum performance over frequency bands of interest.

Antenna 12 is fed at the junction of the two sheet conductors 30, 34 by a coax signal line 40 which may be located along the major axis of the antenna. Antenna 12 is fed by a coax signal line 40 passing through the center of second sheet conductor 34. A feed balun 80 is located beneath the bottom of second sheet conductor 34. Feed balun 80 can be connected to an RF connector 82.

Figure 3:
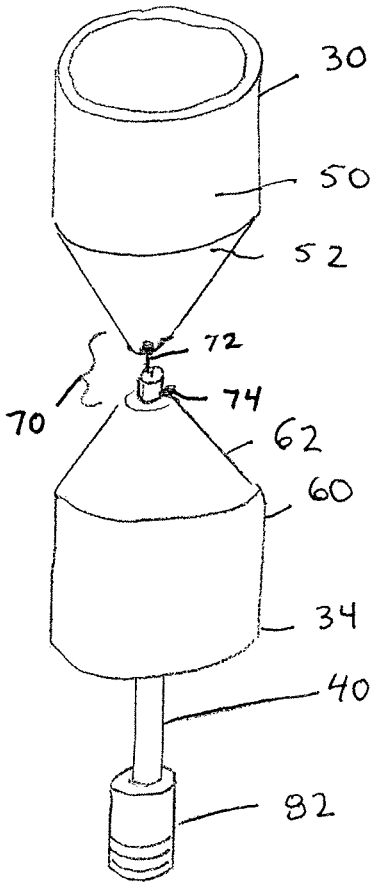
FIG. 3 is a perspective view of a portion of the antenna assembly of FIG. 1.

Referring to FIG. 3, an antenna feedpoint 70 is established between the pair of sheet conductors 30, 34. A center conductor 72 of a coax signal line 40 is connected to a lower end of the first sheet element 30 and the shield conductor 74 of the coax signal line 40 is connected to an upper end of second sheet element 34.

Figure 4:
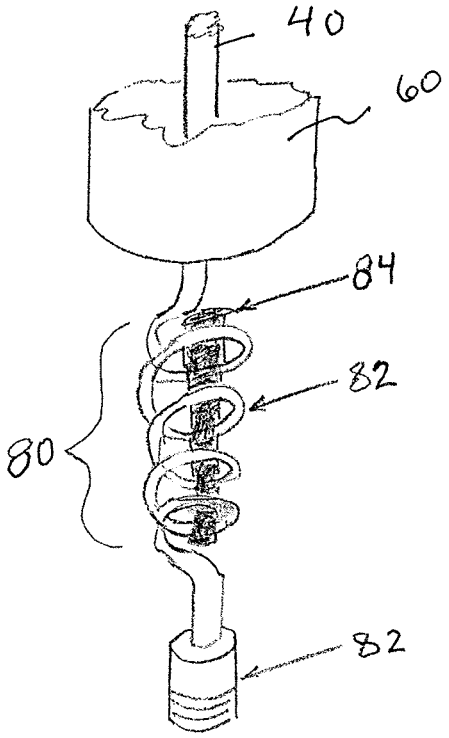
FIG. 4 is a detailed perspective view of a portion of the antenna assembly of FIG. 1.

FIG. 4 is a detailed illustration of the antenna 12 showing a balun 80 formed by a coiled section 82 of coax signal line 40 surrounding a ferrite rod 84.

Figure 5A:
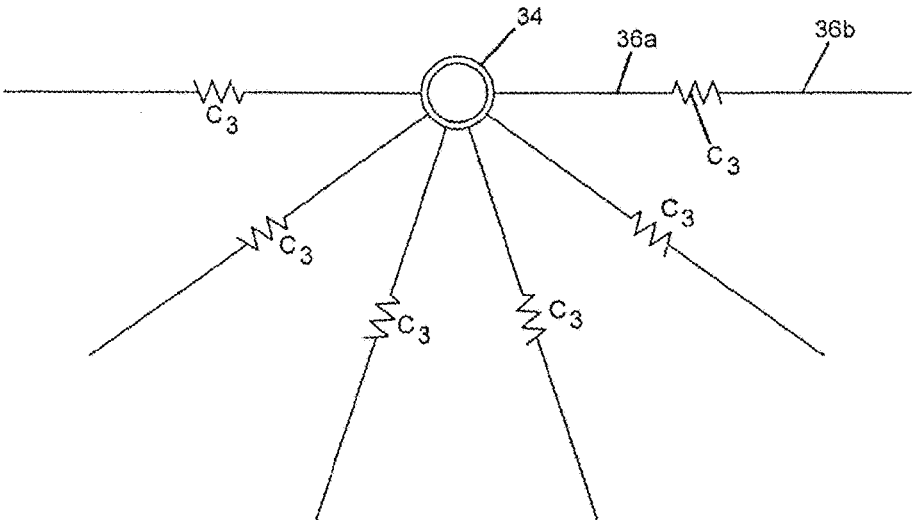
FIG. 5A is a bottom view of the antenna assembly of FIG. 1.
Figure 5B:
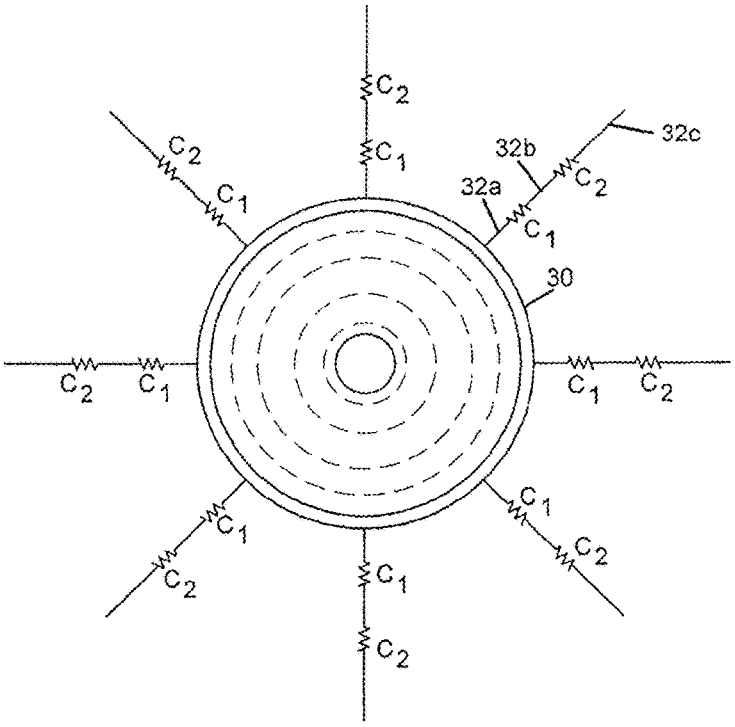
FIG. 5B is a top view of the antenna assembly of FIG. 1

FIG. 5 shows views of antenna 12 taken along the antenna's major axis. FIG. 5A is a view taken from beneath the lower portion antenna 12 of FIG. 2 and FIG. 5B is a view taken from above the upper portion of antenna 12 of FIG. 2.

Figure 6:
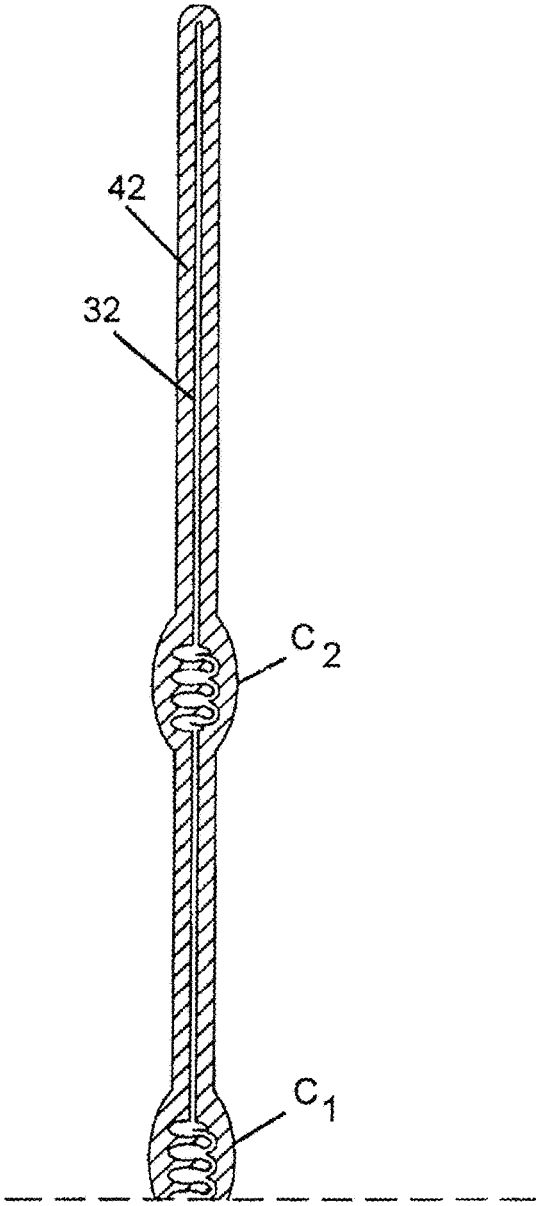
FIG. 6 is a cross-sectional view of a portion of a protected conducting wire element.

FIG. 6 illustrates another embodiment of radiating wire conductor 32, wherein a protective flexible covering 42 encases the conductor. Covering 42 may be a tubing of heat-shrunk material. Other types of coverings 42 would be apparent to those of ordinary skill in the art. Other protective coverings (not shown) may encase sheet conductors 30, 34.

Figure 7:
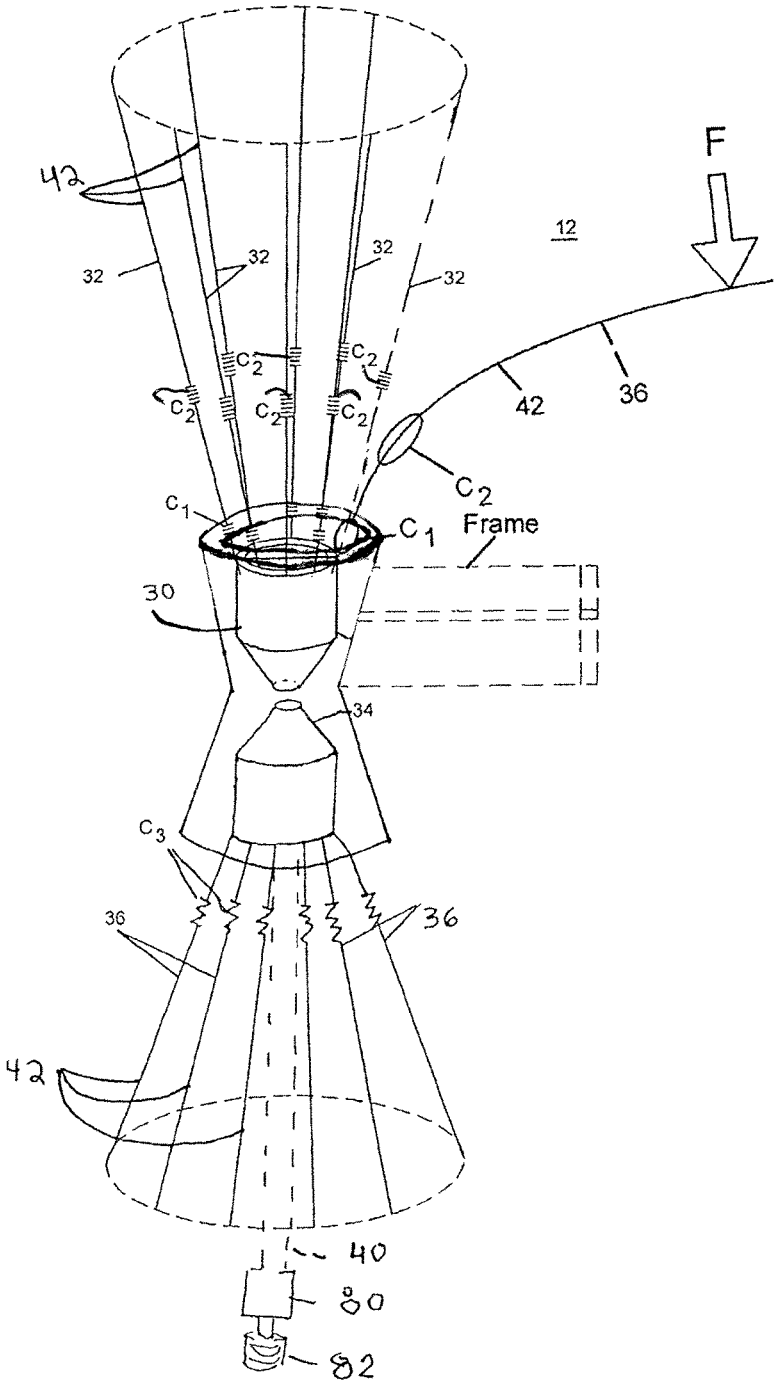
FIG. 7 is a side view of an antenna assembly of the present invention.

FIG. 7 illustrates antenna 12 wherein the plurality of radiating wire conductors 32, 36 are protected by coverings 42. FIG. 7 also illustrates that the radiating wire conductors 32, 36 are preferably substantially deformable in response to external forces. Radiating wire conductors 32, 36 are preferably formed of a material having substantial resiliency so that when the external forces are removed, radiating wire conductors 32, 36 return to their prior orientation. Radiating wire conductors 32, 36 may be of a spring wire, or of a memory wire, such as Nitonol or other types of nickel-titanium shape memory alloys.

Figure 8:
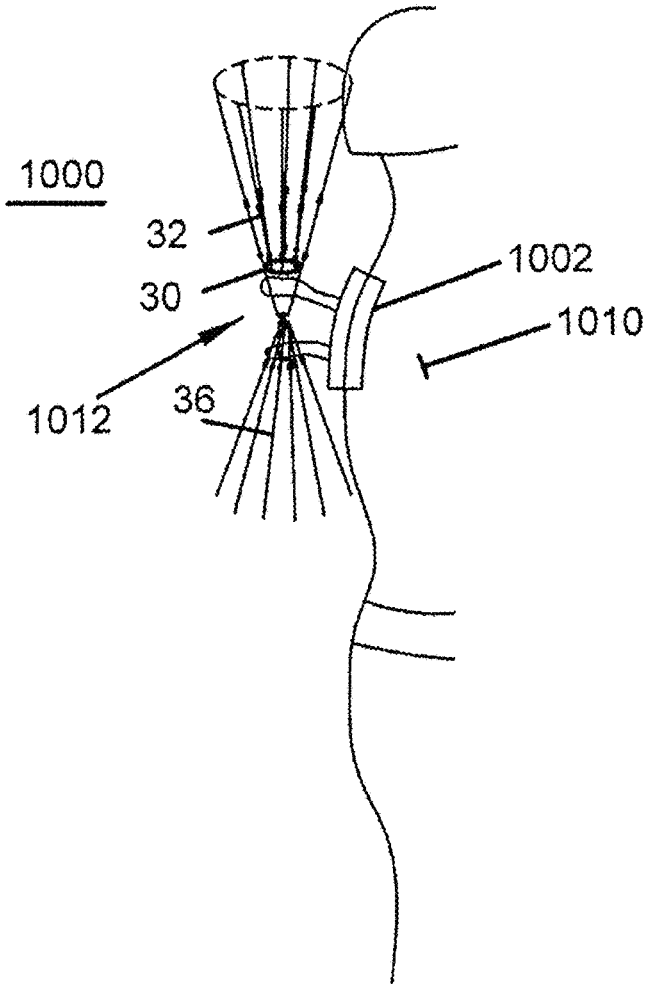
FIG. 8 is a side view of another embodiment of the antenna assembly of the present invention.

FIG. 8 is an exemplary illustration of a transceiver and antenna system 1000 adapted for transportation on a vest 1010. Transmitting unit 1000 includes a transceiver 1002 and antenna 1012 and may include mounting members (not shown), that enable transmitting unit 1000 to be mounted to a standard protective vest. In other embodiments, vest 1010 may be adapted specifically for carrying transmitting unit 1000. For example, protective vest 1010 may include a pouch, straps, or other adaptations (not shown) for carrying transmitting unit 1000.

Figure 9:
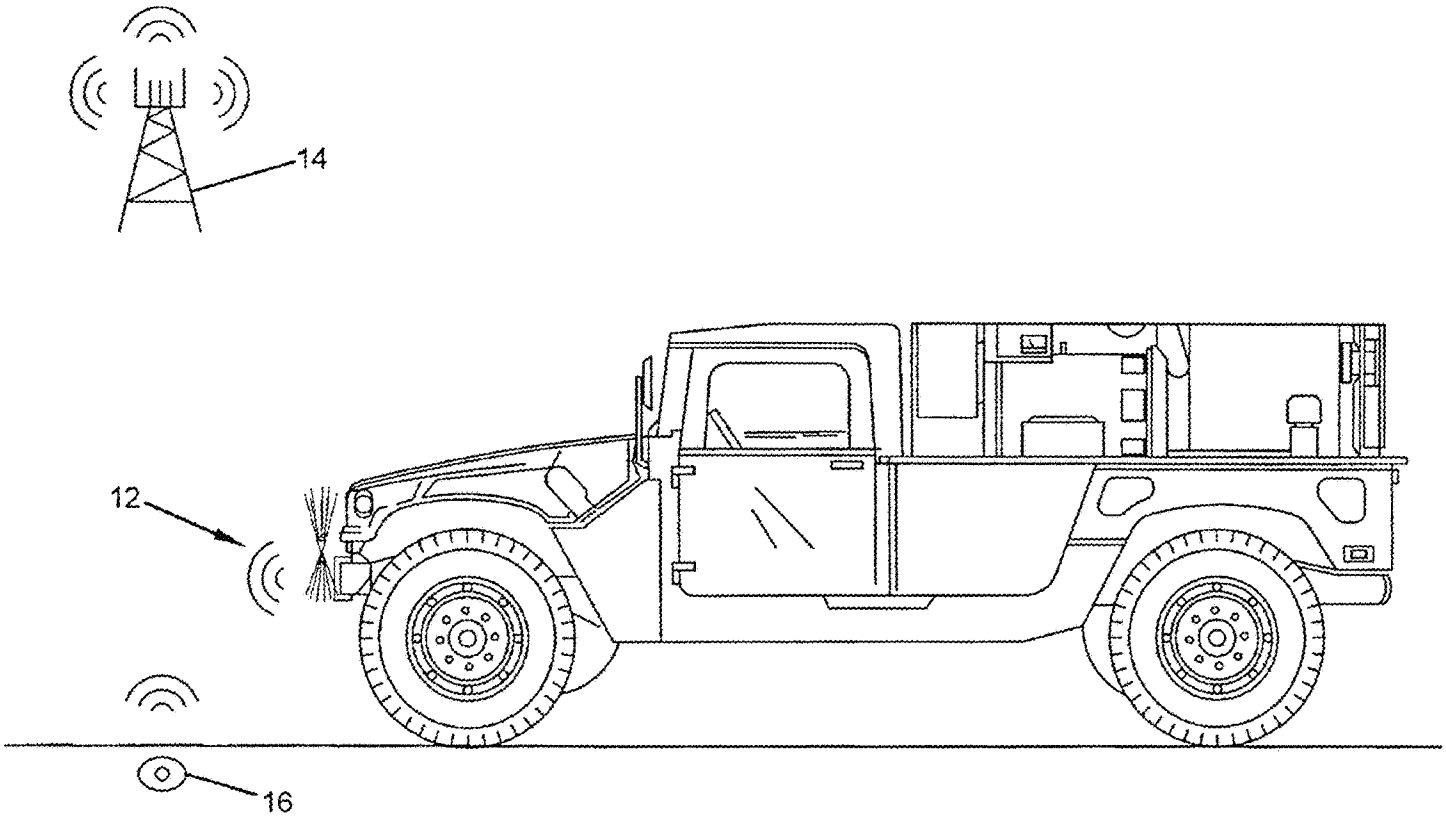
FIG. 9 illustrates another embodiment of the antenna assembly.

Referring to FIG. 9, a radiofrequency system including portable antenna 12 and a remote transceiver 14 operates as a base station and relaying an RF signal to a target wireless receiving device 16, for example an improvised explosive device ("IED"). Portable antenna 12 can be used with a transceiver in a defensive manner to detect or suppress RF transmissions from remote transceiver 14 and/or target receiving device 16.

In some environments, if the target transceiver 14 is unable to initiate or otherwise establish and/or maintain an RF transmission with the target wireless receiving device 16, the target wireless device may not be used for communication, command and control. In other applications, if the target transceiver 14 is unable to initiate or otherwise establish and/or maintain an RF transmission with the target wireless device 16, the target wireless device may not be used as, or as part of, a detonator for an IED. Various other embodiments of the invention may thus be used in a defensive manner to detect or suppress RF transmissions to prevent the detonation of IEDs.

Transceiver 14 may initiate or establish RF transmission, including an uplink RF transmission portion and a downlink RF transmission portion, with target receiving device 16. While illustrated as a wireless device, transceiver 14 include fixed, wired, or wireless devices capable of establishing RF transmissions with target receiving device 16 via at least one wireless path that includes an RF transceiver. As illustrated, RF transmissions may be transmitted from a base station or cell tower. In other wireless communication systems (not shown), RF transmissions may be transmitted from satellite or ground-based repeaters or other types of RF transmitters as would be apparent to those of ordinary skill in the art. Radiofrequency transmissions are generally well known and further discussion regarding their operation is not required.

In addition to antenna configuration, the volume of influence may be affected by other design considerations. These design considerations may include one or more of an amplifier power output, a size of a heat sink for the power amplifiers, heat dissipation, a desired size of the transceiver, a capacity of a battery, an antenna gain, desired frequency bands, a number of frequency bands used, and other design considerations.

FIG. 9 is an exemplary illustration of a transmitting unit adapted for use on a vehicle, such as the US military's HMMWV. Transmitting unit includes a transceiver 14 and antenna 12 and may include mounting members (not shown) that enable transmitting unit to be mounted to a standard military vehicle. In other embodiments, a transmitting unit may be adapted for air-based platforms, including but not limited to unmanned aerial vehicles.

In some embodiments of the invention, the transceiver may operate (selectably or preset) in frequency bands associated with various mobile telephones, such as, 900 MHz, 2.4 GHz, or other wireless telephone frequency bands. Other mobile telephone frequency bands may include "customized" frequency bands that commercial mobile telephone receivers and transmitters may not be to operate at "out of the box." For example, the "customized" frequency bands may include frequency bands that hostile parties have been able to use in the past (e.g., for remote detonation of IEDs and/or communication) by modifying commercially available wireless telephone components. In some embodiments of the invention, the transceiver may operate (selectably or preset) in frequency bands associated with various short range wireless devices such as an electronic car key, a garage door opener, a remote control, or other short range wireless device. In some embodiments of the invention, the transceiver may operate with various combinations of the wireless frequency bands, the wireless telephone frequency bands, and/or the short range wireless device frequency bands.

In some embodiments, the transceiver may transmit in two, three, four, five, or more different frequency bands. For example, in some embodiments of the invention, the transceiver may operate (selectably or preset) in one or more of the same frequency bands as commercially available wireless communication devices, such as, but not limited to, GSM, CDMA, TDMA, SMR, Cellular PCS, AMPS, FSR, DECT, or other wireless frequency bands.

In some embodiments of the invention, the transceiver may detect RF transmissions to a wireless device located within a volume of influence of the detecting transceiver. This volume of influence may be based on various factors including a range between the target wireless device and the transceiver, a range between the target wireless device and the target transmitter, a range between the target transmitter and the transceiver, a transceiver power, a target transmitter power, a target receiver sensitivity, a frequency band or bands of the transceiver, propagation effects, topography, structural interferers, characteristics of an antenna at the transceiver including gain, directionality, and type, and other factors.

In some embodiments of the invention, the volume of influence may be selected or predetermined to be larger than a volume impacted by the detonation of the IED (i.e., the detonation volume or "kill zone"). In some embodiments of the invention, the volume of influence may be selected or predetermined based on whether the transceiver is stationary (e.g., at or affixed to a building or other position) or mobile (e.g., in or affixed to a vehicle, person, or other mobile platform).

In those embodiments where the transceiver is mobile, the volume of influence may be selected or predetermined based on a speed, either actual or expected, of the mobile platform. In some embodiments of the invention, multiple antennas and transmitters may be used to define an aggregate volume of influence. This aggregate volume of influence may be used to detect and/or suppress RF transmissions around a stationary position such as, for example, a base, a building, an encampment or other stationary position, or a mobile position such as a convoy of vehicles, a division of troops or other mobile position. In further embodiments, the multiple antennas and transceivers may also transmit at different frequencies to suppress RF transmissions from a wide variety of wireless devices.

In some embodiments, the invention may be sized and/or configured to be mounted in, affixed to, or otherwise carried in a military vehicle or a civilian vehicle (e.g., an armored civilian vehicle) such as HMMWV or other military vehicle, a GMC Tahoe, a Chevrolet Suburban, a Toyota Land Cruiser, or other civilian vehicle. In some embodiments, the invention may be sized and/or configured to be carried by a person in a backpack, case, protective vest, body armor or other personal equipment or clothing.

In some of these embodiments, an antenna operating with the transceiver may be affixed to a head apparatus of the person, such as a hat or helmet, or be hand-held. In some embodiments, various components of the antenna may be housed in a ruggedized, sealed, and/or weatherproof container capable of withstanding harsh environments and extreme ambient temperatures.

FIG. 10 illustrates a portion of an antenna assembly including a lower polycarbonate radome section 100 and a portion of an upper radome section 102. The lower spring radiating wire conductors 36 are separated and electrically connect to the bottom half of feed element (sheet conductor 34). FIG. 11 shows lower dielectric spacer 104 which functions to keep radiating wire conductors 36 separated within radome section 100. Spacer 104 includes a plurality of channels 105 into which portions of radiating wire conductors 36 are received. An upper dielectric spacer 106 similarly functions as a transition between the radome sections 100, 102. Transition spacer 106 may be inserted into an end of lower radome section 100. Upper radome section 102 may be inserted into transition spacer 106 to mechanically connect the two radome sections 100, 102 together, as shown in FIG. 12. Lower radome section 100 may be secured to transition spacer 106 with threaded fasteners 108. The balum RF choke 82, 84 described above is included in this antenna assembly embodiment. A lower cap 109 seals off the lower end of radome section 100.

Figure 13:
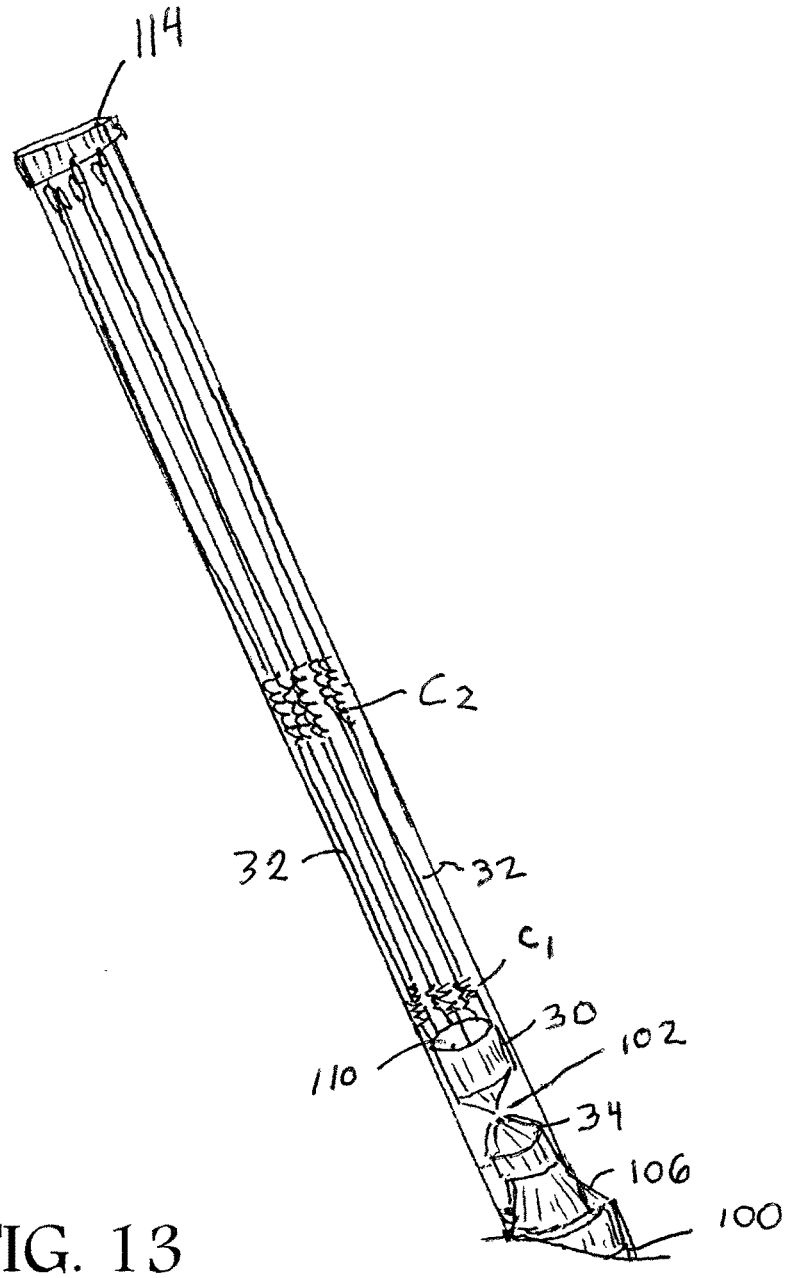
FIG. 13 is a perspective view of the antenna assembly embodiment of FIG. 10.

FIG. 13 illustrates a top portion of the antenna assembly of FIG. 10. The spring radiating wire conductors 32 are separated and electrically connected to the top half of the feed element (sheet conductor 30). Upper radome section 102 is a tubular element and includes a dielectric spacers 110 to maintain separation between radiating wire conductors 32. An upper cap 114 seals off upper radome section 102.

The radome sections 10, 102 are preferably polycarbonate tubular elements, though alternative materials could be utilized. A foam filler (not shown) can be inserted into the radome section 100, 102 cavities to further lock the flexible radiating wire conductors 32, 36 in place. Additionally, the foam filler provides a moisture/debris barrier and improves the overall structural integrity of the antenna assembly. A variety of setting foam fillers may be utilized during manufacture of the antenna assembly.

According to various embodiments of the invention, the antenna and transceiver may be deployed with additional technologies. For example, the antenna and transceiver may be deployed with technologies designed to assess and screen persons, parties, and/or vehicles approaching a designated location, such as, for instance, checkpoints and/or facilities. The screening technologies may be designed to detect bombs being transported by people, within vehicles, or other (e.g., vehicle borne LEDs used in suicide attacks).

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The invention claimed is:

1. A biconical antenna assembly comprising:

a pair of generally cone-shaped conductive elements directed in divergent directions, with one of the pair of conductive elements including a first generally conical sheet conductor and a first generally cylindrical sheet conductor, and a first plurality of radiating wire conductors conductively attached to and extending away from the first cylindrical sheet conductor, and with the other conductive element including a second generally cylindrical sheet conductor and a second generally conical sheet conductor, and a second plurality of radiating wire conductors conductively attached to and extending away from the second cylindrical sheet conductor; and a radome including a pair of tubular sections enclosing at least portions of the first plurality of radiating wire conductors and the second plurality of radiating wire conductors.

2. The biconical antenna assembly of claim 1 further comprising:

a dielectric spacer positioned within one of the tubular sections of the radome and maintaining a separation between the first plurality of radiating wire conductors.

3. The biconical antenna assembly of claim 1 wherein the second plurality of radiating wire conductors are generally equally spaced around one side of the second cylindrical sheet conductor.

4. The biconical antenna assembly of claim 1 wherein the first plurality of radiating wire conductors are generally equally spaced around the first cylindrical sheet conductor.

5. The biconical antenna assembly of claim 1 wherein the radiating wire conductors include one or more chokes.

6. The biconical antenna assembly of claim 5 wherein the chokes are defined as a plurality of loops.

7. A biconical antenna assembly comprising, a pair of generally cone-shaped conductive elements directed in divergent directions, with one of the pair of conductive elements including a first generally conical sheet conductor and a first generally cylindrical sheet conductor, and a first plurality of radiating wire conductors conductively attached to and extending away from the first cylindrical sheet conductor, and with the other conductive element including a second generally cylindrical sheet conductor and a second generally conical sheet conductor, and a second plurality of radiating wire conductors conductively attached to and extending away from the second cylindrical sheet conductor, and wherein the first plurality of radiating wire conductors and the second plurality of radiating wire conductors are of a substantially resilient material, such that upon a deformation in response to an external force, the first plurality of radiating wire conductors and the second plurality of radiating wire conductors return to pre-deformation positions.

8. The biconical antenna assembly of claim 7 wherein a radiofrequency feed point is defined between the first conical sheet conductor and the second conical sheet conductor.

9. The biconical antenna assembly of claim 8 wherein the feed point includes a balun.

10. The biconical antenna assembly of claim 9 wherein the balun includes a coiled section of a coax signal line and a ferrite rod.

11. The biconical antenna assembly of claim 10 wherein a center conductor of a coax signal line is connected to the first conical sheet conductor and a shield conductor of the coax signal line is connected to the second conical sheet conductor.

12. The biconical antenna of claim 11 wherein the coax signal line extends through a center opening in the second conical sheet conductor.

13. The biconical antenna of claim 7 wherein a radome includes at least one dielectric spacer element for separating the radiating wire conductors.

14. The biconical antenna of claim 13 wherein the radome includes at least one dielectric transition element for mechanically connecting a pair of generally tubular radome sections together.

15. The biconical antenna of claim 13 wherein the radome includes a foam filler inserted into one or more cavities.

16. A biconical antenna assembly comprising:

an upper feed element including a first generally cylindrical sheet conductor and a first generally conical sheet conductor, with the first cylindrical sheet conductor conductively attached to a first plurality of radiating wire conductors, said wire conductors extending away from the first cylindrical sheet conductor;

a lower feed element including a second generally conical sheet conductor and a second generally cylindrical sheet conductor, with the second cylindrical sheet conductor attached to a second plurality of radiating wire conductors extending away from the second cylindrical sheet conductor, said second plurality of radiating wire conductors extending in generally opposite directions as compared to the first plurality of radiating wire conductors; and a feedpoint adapted for connection to an RF transceiver, said feedpoint being defined between the first cylindrical sheet conductor and the second cylindrical sheet conductor of the upper and lower feed elements; and a radome enclosure protecting at least some of the radiating wire conductors from deformation from external forces, wherein the radome includes a pair of tubular sections designed to receive portions of the radiating wire conductors.

17. The biconical antenna assembly of claim 16 wherein the feedpoint includes a pair of conductors, with one of the pair of conductors connected to the upper feed element and the other conductor being coupled to the lower feed element.

18. The biconical antenna assembly of claim 16 wherein a coax signal line extends through the lower feed element and terminates at the feedpoint.

19. The biconical antenna assembly of claim 16 further comprising a balun.

20. The biconical antenna assembly of claim 19 wherein the balun includes a coiled section of a coax signal line and a ferrite rod.

21. The biconical antenna of claim 16 wherein the radome includes at least one dielectric spacer element for separating the radiating wire conductors.

22. The biconical antenna of claim 21 wherein the radome includes at least one dielectric transition element for mechanically connecting a pair of radome sections together.

23. The biconical antenna of claim 17 wherein the radome includes a foam filler inserted into one or more cavities.

24. A biconical antenna assembly comprising:

an upper feed element including a first cylindrical sheet conductor and a first conical sheet conductor, with the first cylindrical sheet conductor conductively attached to a first plurality of radiating wire conductors, said wire conductors extending away from the first cylindrical sheet conductor;

a lower feed element including a second conical sheet conductor and a second cylindrical sheet conductor, with the second cylindrical sheet conductor attached to a second plurality of radiating wire conductors extending away from the second cylindrical sheet conductor, said second plurality of radiating wire conductors extending in generally opposite directions as compared to the first radiating wire conductors attached to the upper feed element;

a feedpoint adapted for connection to an RF transceiver, said feedpoint being defined between the first cylindrical sheet conductor and second cylindrical sheet conductor of the upper and lower feed elements; and a dielectric tubular radome protecting the radiating wire conductors of the upper and lower feed elements from deformation from external forces, and wherein the radome includes a pair of tubular sections designed to receive portions of the radiating wire conductors.

* * * * *